United States Patent [19]

Otakie

[11] 3,930,701

[45] Jan. 6, 1976

[54] PORTABLE TELEVISION CABINET SURFACE EXTENDER

[76] Inventor: Daniel A. Otakie, One Benwell Road, Reisterstown, Md. 21136

[22] Filed: Dec. 10, 1973

[21] Appl. No.: 423,505

[52] U.S. Cl. ..... 312/244; 108/28; 108/42; 108/69; 108/90; 108/157; 224/46 R; 312/7 TV; 312/281

[51] Int. Cl.[2] ..... A47B 13/08; A47B 95/02

[58] Field of Search ..... 108/12, 47, 65, 69, 90, 108/28, 42, 157; 112/217.1; 190/11, 42, 60; 312/7 TV, 140.4, 244, 277, 281; 224/46 R, 46 T

[56] References Cited

UNITED STATES PATENTS

| | | | |
|---|---|---|---|
| 1,413,111 | 4/1922 | Fricker | 108/190 |
| 1,848,475 | 3/1932 | Hackett | 108/69 |
| 1,904,897 | 4/1933 | Kahrs | 108/90 |
| 2,341,635 | 2/1944 | Loesch | 224/46 R X |
| 2,572,333 | 10/1951 | Greitzer | 108/90 |
| 2,634,183 | 4/1953 | Derman | 108/90 |
| 2,955,888 | 10/1960 | Graves | 108/69 |
| 3,633,519 | 1/1972 | Nichol | 108/44 |

FOREIGN PATENTS OR APPLICATIONS

| | | | |
|---|---|---|---|
| 643,301 | 9/1950 | United Kingdom | 108/47 |

*Primary Examiner*—Roy D. Frazier
*Assistant Examiner*—William E. Lyddane
*Attorney, Agent, or Firm*—John F. McClellan, Sr.

[57] ABSTRACT

A detachable-table unit for extending the available and useful work and storage surfaces of portable television cabinets, including a top, an outer frame below the top for support on portable television cabinets and an inner frame and movable rod structure for securing the unit from sliding or tipping by enclosing the television handle and fitting against it beneath the grip; other embodiments include adjustment, buffet, drop leaf, shelving, drawer and antenna access features.

34 Claims, 24 Drawing Figures

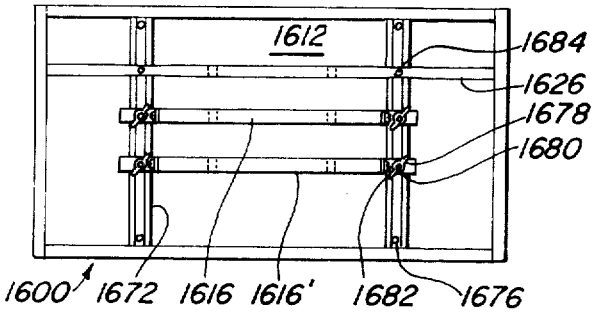
FIG. 16
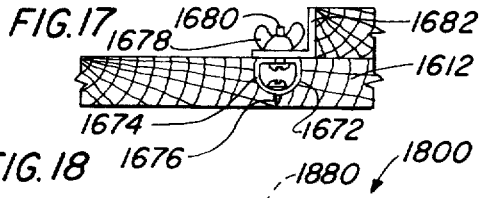
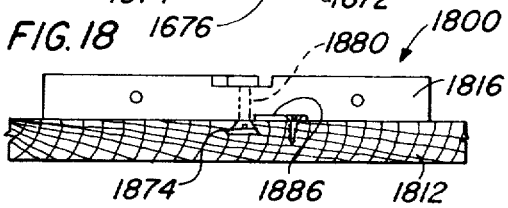
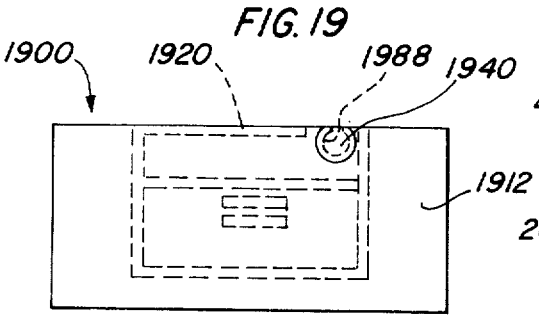
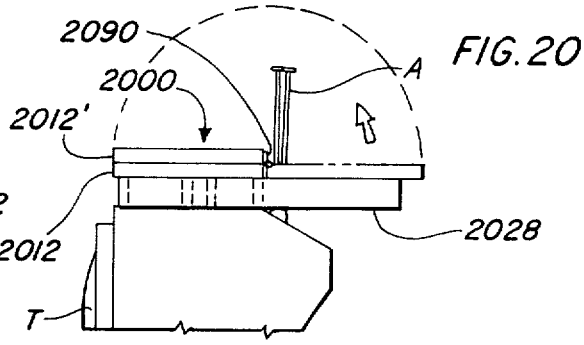
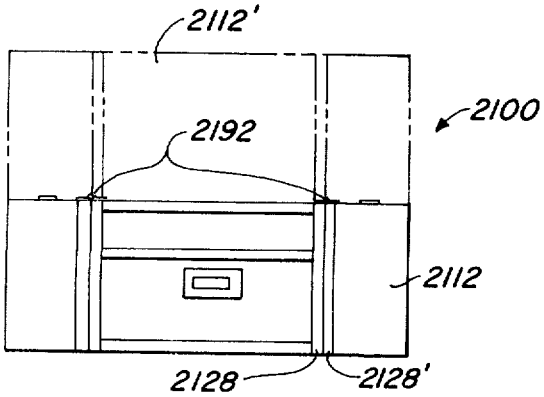
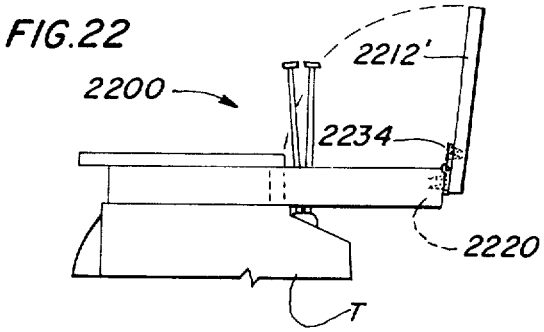
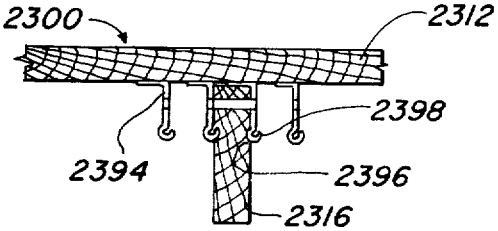
FIG. 23
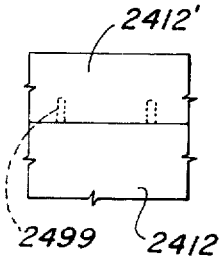
FIG. 24

PORTABLE TELEVISION CABINET SURFACE EXTENDER

This invention relates generally to furniture and specifically to surface extenders.

A principal object of the invention is to provide a portable television set cabinet surface extender in the form of a table-like top for detachable securance to the television set cabinet.

In the prior art various surface extenders have been disclosed, U.S. Pat. No. 3,633,519 to George D. Nichol discloses a flat, rectangular top with a peripheral downwardly protruding frame and an inner frame for clamping over a golf cart wheel to form a seat; U.S. Pat. No. 3,389,408 to A. G. Pearson discloses a bathtub edge surface extender; U.S. Pat. No. 3,201,186 to W. K. Noonan discloses a bath tub-edge seat; U.S. Pat. No. D197,729 to Samuel Beychok, U.S. Pat. No. 3,048,457 to R. G. Haase, and U.S. Pat. No. 1,908,988 to F. S. Lack disclose various straddle-mounted trays.

However, the prior art has not provided a portable TV cabinet surface extender which simply, quickly, adjustably and securely attaches to the top handle of the average portable TV, and in various embodiments affords additional table, shelf and drawer area, as a handsome, durable and economical furniture accessory which enhances the appearance of portable television sets, according to further objects of this invention.

In brief summary given for purposes of cursive description only, an embodiment of the invention includes a horizontal top, an outer rectangular frame extending downwardly from the top in position for resting on the periphery of a TV cabinet top, a pair of fixed inner members and one or more transverse movable members for securing the invention to the top mounted handle of a TV cabinet.

The above and other objects and advantages of the invention will become more readily apparent on examination of the following description, including the drawings in which, like numerals indicating like parts;

FIGS. 16 and 17 are respectively a bottom plan view and a fragmentary inverted-front-elevation detail in partial section of an embodiment;

FIG. 18 is an inverted-front-elevation detail in partial section of an embodiment;

FIG. 19 is a top plan view of an embodiment;

FIG. 20 is a side elevation of an embodiment;

FIG. 21 is a bottom plan view of an embodiment;

FIG. 22 is a side elevation of an embodiment; and

FIG. 23 is a fragmentary side-elevation sectional detail of an embodiment; and FIG. 24 is a plan detail.

Figures 1, 2, 3, 4, 5, 6, 7, 8, 9, 10, 11, 12, 13, 14, 15:
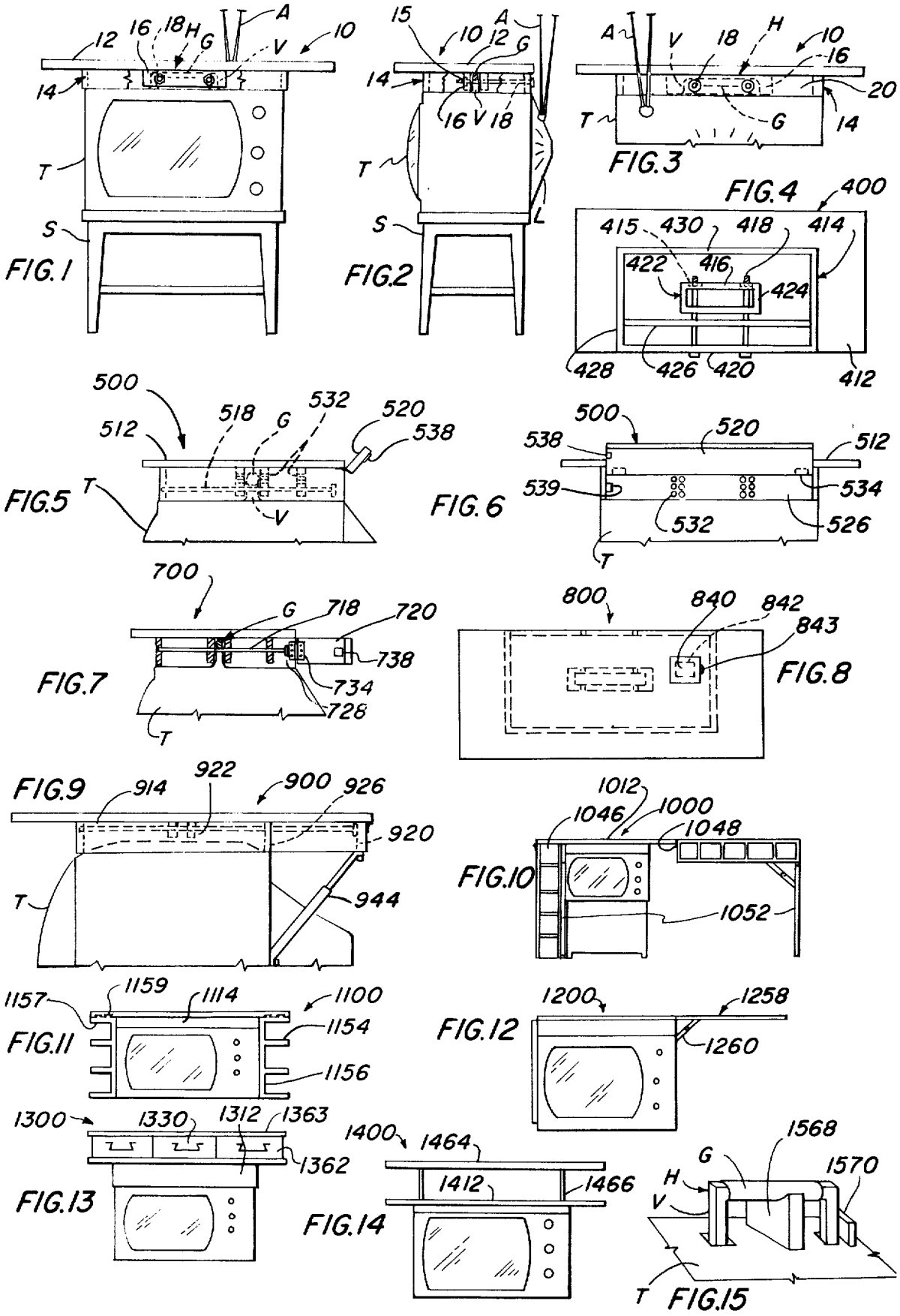
FIGS. 1 and 2 are front and side elevations partly in section of an embodiment of the invention installed for use with a television cabinet.
FIG. 3 is a fragmentary detail in rear elevation of the invention of FIGS. 1 and 2.
FIG. 4 is a bottom plan view of an embodiment of the invention.
FIGS. 5 and 6 are side and rear elevations of embodiments of the invention.
FIG. 7 is a side elevation in partial section of an embodiment of the invention installed for use.
FIG. 8 is a top plan view of an embodiment of the invention.
FIG. 9 is a side elevation of a further embodiment installed for use.
FIGS. 10, 11, 12, 13 and 14 are front elevations of further embodiments of the invention installed for use.
FIG. 15 is an isometric fragmentary detail.

FIGS. 1, 2 and 3 show embodiment 10 of the invention in the form of a detachable portable TV cabinet table comprising on the exterior a horizontal planar member or top 12 having a downwardly extending rectangular or outer frame 14 positioned for engaging the periphery of the substantially horizontal upper portion or top of a typical portable television cabinet. A set of parallel-spaced downwardly extending plate-like member 16 comprising a second or inner frame is secured to the underside of the top longitudinally within the outer frame for engaging the front and back faces of a typical upwardly-protruding TV carrying handle H, having vertical side arms and horizontal grip G. Finally a handle-engagement including one or more elongate members or rods 18 such as the pair shown positioned to pass beneath the handle transversely through the set of downwardly extending members 16 fastens the detachable table to the TV set. The rods may be threaded and nuts 15 provided (FIG. 2) affixed to the plate-like members 16 in position for retaining the rods. Preferably the rods pass through the upper corners of the opening under the handle tightly fitting against the vertical side arms V of the handle and the horizontal grip G of the handle, securely wedging the lower surfaces of the frame against the upper surface of the TV cabinet and constraining lateral movement of the unit relative to the TV set. It can be seen that the foregoing arrangement in no way interferes with the setting of typically mounted antennas, is easily operated to attach and detach the unit atop the TV cabinet, and makes a trim, efficient installation from any view.

Preferably, in embodiment for use with compact-length picture tube TV sets, the top of the detachable unit extends horizontally past the sides and front of the TV set when installed, but not rearwardly, providing room for manipulation of the antenna A and preserving full upward ventilation through the customary TV louvers L. The flat table-top area provided by the invention easily doubles or triples the usable area above the TV, not only through surface extension but also through elimination of the usual handle-obstruction, and as will be seen, through providing a flat surface in place of the familiar cambered upper surface of some TV cabinet tops.

The overhang tends to reduce reflections at the picture tube, and to soften the mechanical look of TV sets.

The flat surface provided forms an extraordinarily useful table for reading while standing, for use as a bar top, a shelf out of reach of young children, and the like, particularly where table space may be at a premium as in apartments.

Because of appearance and acoustic qualities, wood is the preferred material for the unit, preferably having an alcohol resistant finish, but plastic may also be used, and even metal, although the non-abrasive, non-conductive, and more massive qualities of wood recommend it.

FIG. 4 illustrates a bottom view of an embodiment 400 preferred for simplicity and strength, including top 412, rectangular outer frame 414, and inner frame 422 comprising the previously described set of downwardly extending member 416 and end pieces 424 closing off the end to comprise an inner rectangular frame generally aligned with the outer frame. Size of the inner frame is made such as to fit tightly around the handle at the front, back and ends, aided by spacers if necessary, which can be wedged, glued, or screwed inside the inner frame. An intermediate reinforcing and stiffening rib 426 parallel-aligned with the back 420 of the outer frame joins the ends 428 of the outer frame. Rods 418 pass through sets of respective parallel-spaced, co-aligned openings in the rib 426, the inner frame 422, and into nuts 415 in member 416.

FIG. 5 and FIG. 6 show details of an embodiment 500 having a vertically and laterally spaced plurality of co-aligned holes 532 for adjustment of the rods to fit tightly against the TV handle.

As illustrated, plural holes on each side pass through the rib 526 and the front and back members of the inner frame. Rod-knob access in this embodiment is by way of a pivotal outer frame back 520 which fits inside the sides of the frame and which may be raised by pivoting about a horizontal axis on hinges 534 (preferably concealed) connecting it with the top 512, thus preserving the appearance of an unbroken-frame when shut. Magnetic latching means 538, 539 may be used to hold the back shut. The rods extend from the front to the back inside the outer frame, and are held in by the hinged member.

FIG. 7, a section, shows an embodiment 700 with an alternative to the rod-access arrangement of the back in the prior Figure. Outer frame back 720 may have a hinge 734 secured at one end, pivotally joining it about a vertical axis to an end 728 of the outer frame, and a magnetic catch 738 may be provided to hold it shut to a similar member in the outer frame, not shown.

FIG. 8 illustrates an embodiment 800 having provision permitting use of the invention with a TV set having a top-mounted antenna. One or more knock-out or lift-out panels 840 in the top provide antenna passage through the top when removed at the appropriate location. Bevel-edges 842 or other conventional means are employed for panel retention when in place, and a finger nail indentation 843 may be provided for ease of removal. The vertical assembly method of this invention in which no lateral motion is necessary, permits straight-down installation over the antenna and the handle simultaneously.

FIG. 9 shows a further embodiment 900 especially well adapted for use with TV cabinets having relatively long picture-tube rearward extensions. The unit may extend rearward of the cabinet, employing rib 926 to bear on the cabinet top rear edge. An adjustable diagonal brace 944 stabilizes the rearwardly extended portion. Access to the rods is from the rear, the rearmost member 920 being hinged.

A further feature appearing in this embodiment is that of fitting a non-flat or contoured TV cabinet top. The outer frame 914 contacts the edges of the top only, and the inner frame 922 is upwardly recessed, avoiding any upward bulge of the midportions of the TV top.

FIG. 10 shows an embodiment 1000 of the invention in which the detachable table has one or more surface extending pigeon-hole type shelving portions in a leaf 1046 affixed to it and extending downwardly from the lateral overhang of the detachable table top 1012. Preferably the thickness of these portions is equal to the detachable table top lateral overhang, producing a harmonious, unitary appearance. The shelving portions may extend to and rest on the floor if desired. One or more of the shelving portions has a hinge 1048 connecting the outboard face with a laterally overhanging margin of the top of the detachable table unit, in the manner of a table dropleaf, and a folding leg 1052 to support it in the horizontal position, forming a pigeon hole desk. Any floor clearance required in folding and unfolding full length shelf units can be had by removing or loosening the retaining rod structure in the detachable table top, restoring the rod structure after the maneuver is complete, or clearance may be provided by stopping the shelf units short of the floor. FIG. 11 illustrates a simpler shelf-equipped embodiment 1100. Fixed, open end vertical shelving 1154 depends from the laterally overhanging portions of the top by a vertical member 1156 joining a dovetailed member 1157 at the top beneath each lateral overhang, the overhangs having corresponding dovetails 1159.

FIG. 12 shows an embodiment 1200 having a short (portable TV cabinet height) drop leaf 1258 forming the lateral surface-extension on each side. A brace 1260 of the folding type may be recessed in the drop leaf and/or the outer frame to which it connects or may be rear-mounted.

FIG. 13 shows an embodiment 1300 in which one or more convenient drawers 1362 are recessed into the front 1330 of an upper surface extending member 1363 affixed on top of member 1312.

FIG. 14 illustrates an embodiment 1400 demonstrating further versatility of the basic invention, in that further structure such as a shelf 1464 parallel-spaced above the top 1412 of the detachable table unit on legs 1466, can be attached to and above the unit, such is the stability afforded by the weight of the TV, the strength and rigidity of the handle attachment, and the spread stance of the outer frame.

FIG. 15 shows a wedge member or adaptive block 1568 supplied as part of this invention for wedging under grip G and stabilizing folding handle H of a TV cabinet, permitting easier installation of the detachable table unit. A further block 1570 may be wedged or glued into the space between the handle clamping members in the detachable table unit, outboard of the vertical side arms V of the handle to prevent shifting, if the fit requires this.

FIGS. 16 and 17 illustrate an embodiment 1600 of the invention having provision for adjusting the position of and the spacing between downwardly extending frame members 1616, 1616'. A pair of slotted metal channels 1672 is secured in flush-recessed position in grooves 1674 in the top 1612 by screws 1676, transverse to the downwardly extending members 1616, 1616'. Wing nuts 1678 on screws 1680 having screw-heads captured in the slotted metal channels adjustably secure the downwardly extending frame members 1616, 1616' by means of an angle 1682 screwed to each end of each member.

As a further feature, rib 1626 may be mounted to the channels by recessed screws 1684 so that adjustment can be made to accommodate TV cabinets of different depths. In alternative arrangement, the ends can be adjustably secured to dovetail slots in the outer frame or the top.

FIG. 18 in a similar but modified embodiment 1800 represented by the detail shown, indicates how the downwardly extending members 1816 can be held by flathead screws 1880 captured in dovetail grooves 1874 in the top 1812. One or more metal plates 1886 may be screwed to the top to reinforce the dovetail grooves. Also indicated by this Figure is the feature that only one groove (or one metal channel as in the previous Figures) will secure the center of the lengths of a downwardly extending member 1816 sufficiently well for gripping TV handles.

FIG. 19 shows an antenna-access embodiment 1900 having a lift-out panel 1940 similar to that of FIG. 8 but with the aperture in which it fits being a slot 1988 in the back margin of the top 1912 instead of a hole in the top. Rear frame member 1920 can stop short of the slot, permitting the antenna to move freely into and out of the slot when the panel is removed. The panel may be circular as shown to facilitate smooth passage of antenna members around the aperture.

FIG. 20 illustrates a further antenna-access embodiment 2000 in which the front portion 2012 of the top is fixed and has a hinge provision 2090 at the rear edge permitting the rear portion 2012' of the top to pivot about the forward edge and lie over the front portion, opening the way for antenna deployment. The ends 2028 of the outer rectangular frame can extend to the rear as shown to support the rear portion 2012', or the rear portion can be supported by the hinge or by struts.

FIG. 21 shows an embodiment 2100 in which the top folds as in the prior embodiment and in which the rearward halves 2128 of the outer frame ends pivot about vertical axes on hinges 2192 affixed to the forward halves 2128, so that they can fold out and around to lie against the forward halves when not extended as supports for the rear half 2112' of the top.

FIG. 22 shows an antenna-access embodiment 2200 in which the rearward half 2212' of the top pivots upwardly from the center on hinges 2234 attached to the rear portion 2220 of the outer frame.

FIG. 23 shows a detail of an embodiment 2300 like the FIG. 1 embodiment except that spring clips 2394 affixed beneath the top 2312 adjustably receive and position the inner frame members 2316, which may have grooves 2396 to receive retentive contours 2398 on the spring clips when positioned therebetween.

Rod attachment in the various embodiments where not detailed may be as in FIG. 1.

FIG. 24 indicates an alternative means of attachment for the movable top leaf portion, exemplified by 2412', showing attachment by dowels 2499 of the detachable top leaf portion. This arrangement can be used in place of the hinges in the arrangements of FIGS. 20–22.

Obviously many modifications and variations of the present invention are possible in light of the above teachings. It is, therefore, to be understood that within the scope of the appended claims the invention may be practiced otherwise than as specifically described.

What is claimed and desired to be secured by United States Letters Patent is:

1. In combination, a television cabinet having a substantially horizontal upper portion, a handle upwardly protrusive from said upper portion and having a recess defining a horizontal grip, a surface extender resting on said upper portion, handle engaging means including a laterally extending member carried by surface extender and engaging under said horizontal grip of said handle, and a portion of the surface extender extending beyond said substantially horizontal upper portion.

2. In the combination of claim 1, the surface extender including a horizontal top, and the portion of the surface extender resting on said upper portion comprising a frame, said frame extending above said upper portion higher than the upward protrusion of said handle and depending downwardly from the top in position for resting on the periphery of said horizontal upper portion.

3. In the combination of claim 2, said handle engaging means including a second frame, and means for securing the second frame to the top with portions of the second frame on opposite sides of the handle.

4. In the combination of claim 3, said handle said handle engaging means including at least one elongate member passing through at least a portion of the second frame and below a portion of the handle.

5. In the combination of claim 3, said handle-engagement including contact between the handle and said portions of the second frame on opposite sides of the handle.

6. In the combination of claim 5, said handle horizontal grip having a vertical support at each end, each of said second frame portions having a pair of holes passing therethrough with respective pairs of in opposite portions of said second frame holes being coaxially aligned and said handle engaging means including a pair of rods passing through said holes beneath the horizontal grip with one rod adjacent each vertical support.

7. In the combination of claim 6, each of said second frame portions having a plurality of said pairs of holes therein.

8. In the combination of claim 6, wherein a portion of the first said frame has a pair of holes therein coaxially aligned with the first said pairs of holes, and wherein the pair of rods passes through the pair of holes in the first said frame portion.

9. In the combination of claim 8, and means on an end of at least one rod for releasably securing the rod in place.

10. In the combination of claim 6, wherein an intermediate member is provided, wherein means are provided for securing the intermediate member beneath the top in spaced relation with one of said portions of the second frame and an aligned portion of the first frame, wherein the intermediate member has a pair of holes therein coaxially aligned with the first said pairs of holes, and wherein the pair of rods passes through the pair of holes in said intermediate member.

11. In the combination of claim 10, and hinge structure attaching the aligned portion of the first frame pivotally about a horizontal axis beneath the top.

12. In the combination of claim 10, and hinge structure attaching the aligned portion of the first frame pivotally about a vertical axis beneath the top.

13. In the combination of claim 12, and means for latching the aligned portion of the first frame and thereby retaining the aligned portion against another portion of the first frame.

14. In the combination of claim 10, said intermediate member being positioned to rest on a peripheral part of the television cabinet substantially horizontal upper portion, said extending portion of the surface extender extending therebeyond, and an adjustable brace connecting said extending portion of the surface extender with the television cabinet.

15. In the combination of claim 6, a second surface extender, and means for movably securing the second surface extender to the first said surface extender.

16. In the combination of claim 15, the second surface extender comprising a leaf and said means for movably securing comprising hinge structure pivotally securing the leaf to a margin of the top.

17. In a combination of claim 16, the leaf having pigeonhole structure attached thereto, said margin of the top being a laterally overhanging margin, hinge structure on a portion of the leaf opposite said laterally overhanging margin of the top, and a leg pivotally secured by said hinge structure on the leaf.

18. In the combination as recited in claim 6, a wedge member proportioned to fit between said handle and television cabinet, for thereby supporting the handle in the upwardly projecting position.

19. In the combination of claim 6, a second surface extender comprising a horizontal planar member, and means for parallel spacing the horizontal planar member in fixed relation above the top.

20. In the combination of claim 19, and at least one drawer between said horizontal planar member and said top.

21. In the combination of claim 5, wherein the portion of the surface extender extending beyond said substantially horizontal portion comprises a laterally overhanging margin of said top, wherein a vertical set of shelves is provided, and wherein means are provided for movably securing the vertical set of shelves to the top, comprising dovetail structure detachably securing the topmost shelf of said vertical set of shelves to the laterally overhanging margin of the top.

22. In the combination of claim 4, the second frame comprising a pair of spaced downwardly extending members, and means for adjusting the spacing between said downwardly extending members.

23. In the combination of claim 4, said means for securing including means for adjusting the position of the second frame relative to the top.

24. In the combination of claim 23, said means for securing including means for adjusting the spacing between said portions of the second frame.

25. In the combination of claim 24, said means for securing comprising at least one slot structure affixed to the top, and means for releasably connecting the slot structure and said second frame.

26. In the combination of claim 4, an intermediate member, and means for adjusting said intermediate member in position relative to said top.

27. In the combination of claim 4, a portion of the top having an aperture therein, and a panel detachably secured in said aperture.

28. In the combination of claim 27, said aperture being a slot in the rear margin of the top, for thereby providing antenna access.

29. In the combination of claim 4, the top having a fixed forward portion, a rearward portion, and a hinge securing the rearward portion pivotally relative to the forward portion.

30. In the combination of claim 29, the hinge affixed at the rearward edge of the forward portion and the forward edge of the rearward portion, whereby the rearward portion of the top can pivot into overlying relationship with the forward portion, thereby providing access for antenna deployment from beneath the rearward portion of the top.

31. In the combination of claim 29, the hinge affixed at the rearward edge of the rearward portion and to the first said frame, thereby providing access for antenna deployment from beneath the rearward portion of the top.

32. In the combination of claim 4, wherein the means for securing the second frame comprises a spaced plurality of resilient members protrusive downwardly from the top, wherein the second frame comprises a pair of downwardly extending members having grooves therein for engaging a portion of the resilient members when positioned therebetween.

33. In the combination of claim 4, the top having a fixed forward portion, a separate rearward portion, and means for detachably fixing the rearward portion in relation to the forward portion.

34. The combination of a surface extender and a television cabinet having a handle on the upper surface thereof, the surface extender comprising: a horizontal top, a frame depending downwardly from said top, and a laterally projecting elongate handle engaging member secured to said surface extender in vertically spaced relation with the underside of, said top said handle engaging member being axially slideable for thereby engaging said handle.

* * * * *